United States Patent [19]

Anderson

[11] 4,375,408

[45] Mar. 1, 1983

[54] ELASTOMERIC FRAMING MEMBER FOR SCREEN DECK PANEL

[75] Inventor: Thomas A. Anderson, Vadnais Heights, Minn.

[73] Assignee: UOP Inc., Des Plaines, Ill.

[21] Appl. No.: 290,121

[22] Filed: Aug. 5, 1981

[51] Int. Cl.[3] ..... B07B 1/46

[52] U.S. Cl. ..... 209/405; 209/395; 209/408

[58] Field of Search ..... 209/393-395, 209/404, 405, 408, 414; 210/499; 55/152

[56] References Cited

U.S. PATENT DOCUMENTS

| | | | |
|---|---|---|---|
| 208,773 | 10/1878 | Tyson | 209/395 |
| 643,521 | 2/1900 | McCarroll | 209/414 |
| 1,036,430 | 8/1912 | Bovery | 209/395 X |
| 2,899,061 | 8/1959 | Schroth | 209/408 |
| 3,042,206 | 7/1962 | Olender | 209/405 X |
| 3,390,771 | 7/1968 | Wehner | 209/408 X |
| 3,463,315 | 8/1969 | Riesbeck et al. | 209/405 X |
| 4,219,412 | 8/1980 | Hassall | 209/408 X |
| 4,283,278 | 8/1981 | Savage et al. | 209/405 X |

FOREIGN PATENT DOCUMENTS

| | | | |
|---|---|---|---|
| 572745 | 11/1958 | Belgium | 209/395 |
| 1331348 | 5/1963 | France | 55/152 |
| 2067100 | 7/1981 | United Kingdom | 209/395 |

*Primary Examiner*—Richard L. Chiesa

*Attorney, Agent, or Firm*—James R. Hoatson, Jr.; Barry L. Clark; William H. Page, III

[57] ABSTRACT

Molded elastomeric framing member has internal horizontal and vertical slots which are adapted to frictionally engage several of the longitudinal profile surface wires and portions of the transverse support bar members along a side edge of a flat deck screen panel. Parallel top and bottom portions of the framing member are adapted to be engaged by a support surface of a vibrating screen apparatus and a clamping apparatus carried by said screen apparatus. The framing member prevents metal-to-metal contact between the screen panel and vibrating apparatus, thus reducing the noise level of the apparatus. It also helps protect persons handling the panel from possible injury by rough edges and eliminates the expense and labor associated with the welding of side panels to the ends of the support bars. To prevent the screen panel from becoming electrically isolated from the vibrating screen apparatus, the elastomeric framing member can be made electrically conductive.

6 Claims, 4 Drawing Figures

FIG. 1
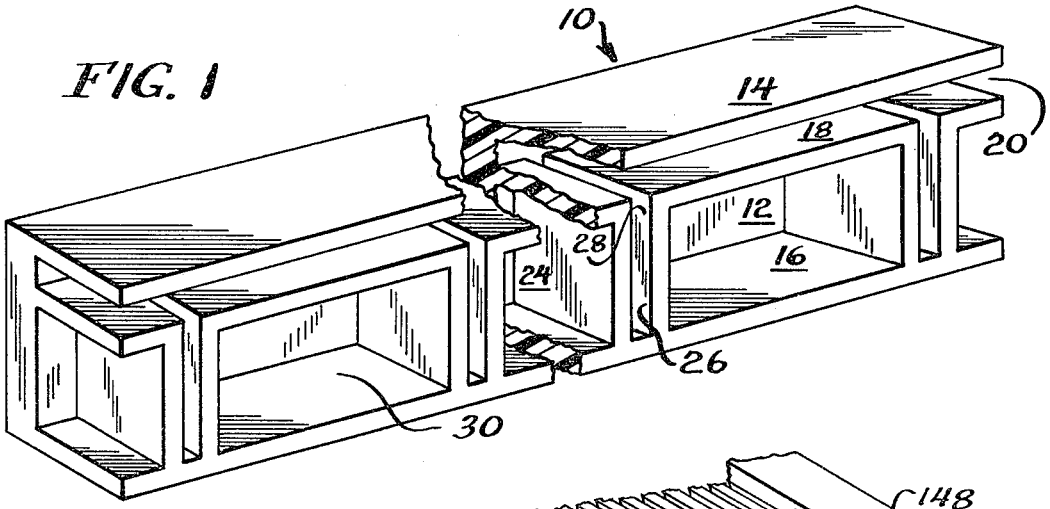
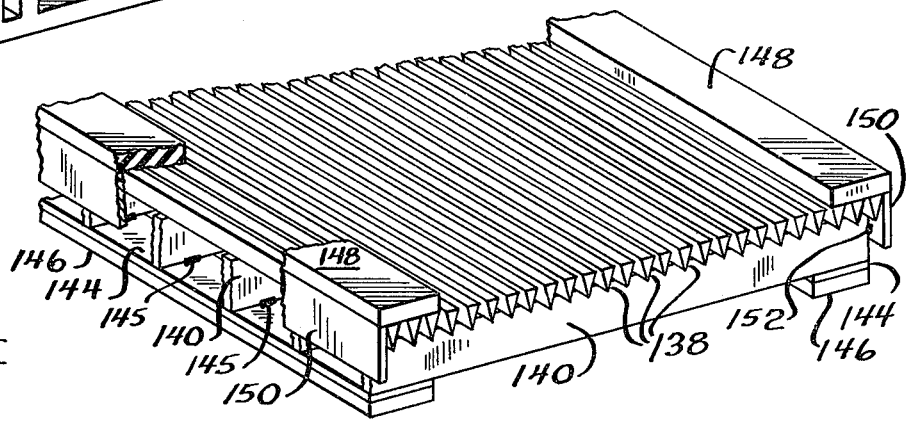
FIG. 2
PRIOR ART
FIG. 3
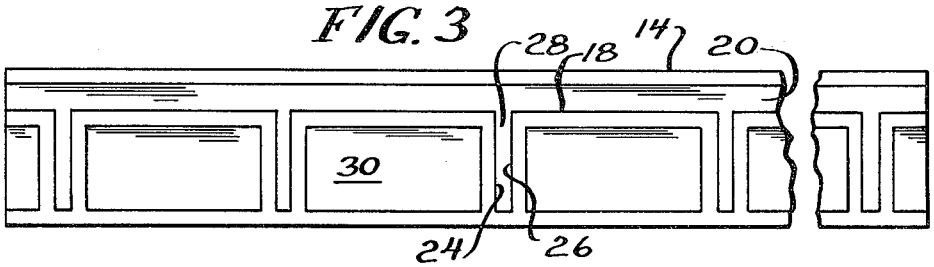
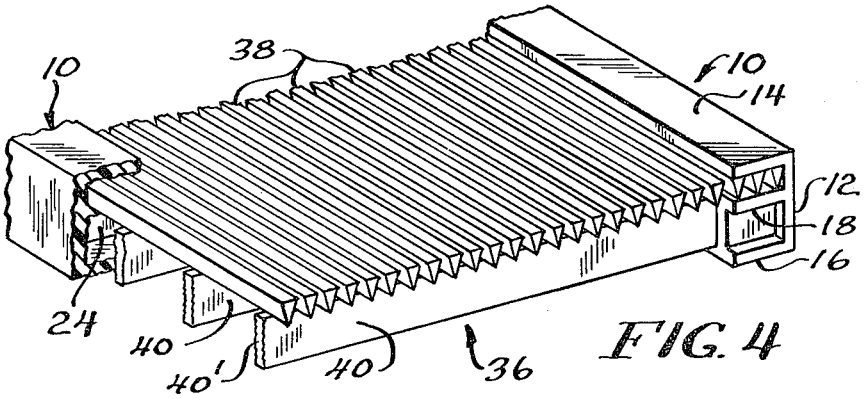
FIG. 4

ELASTOMERIC FRAMING MEMBER FOR SCREEN DECK PANEL

BACKGROUND OF THE INVENTION

The invention relates to self-supported profile wire flat deck screen panels mounted on vibrating screens to dewater and classify materials, and particularly to arrangements for mounting said panels so they can be used in a vibrating apparatus. Typically, the panels are 4'×2' and are held down by a clamping assembly which permits their easy removal when their surface is worn. To achieve sufficient strength for the panel so that it can span the approximately 2' between mounting points, the wire surface is welded to a plurality of transverse rectangular support bars which depend in a vertical direction from the lower edges of the wires. To protect workers handling the rough and sharp ends of the rectangular supports, a vertical side panel or frame is generally welded over the ends of the supports. A wide horizontal, metal-bearing strip is also welded to the bottoms of the support bars at the panel side edges to provide a flat surface for contacting an elastomeric insulating strip which is positioned between the underside of the bearing strip and the top surface of the frame of the vibrating apparatus. The elastomeric strips prevent metal-to-metal contact, thus reducing noise and wear.

SUMMARY OF THE INVENTION

It is among the objects of the present invention to provide an improved framing member for a screen deck panel which will eliminate the necessity of providing edge frame members, separate cushion strip members, and in most cases, bearing strip members. Another object is to provide superior noise control and cushioning of the edges of the screen panel to protect persons handling it. These and other objects are achieved by the framing member of the present invention which comprises an elongated, rectangular, bar-like structure molded of an elastomer such as polyurethane. The top and bottom of the bar are parallel to each other and are generally smooth and planar. One vertical side wall is preferably solid, while the opposing side wall is deeply slotted, both in a horizontal direction parallel to its top and vertically by means of a plurality of short slots which intersect the horizontal slot. The elastomeric structure is easily assembled to a screen panel by hand, is retained thereon by friction during handling, and can be reused if desired. In order to provide sufficient support, the durometer of the elastomer should preferably be at least 60 Shore A. To facilitate assembly, the durometer should preferably be less than 90 Shore A. A range of 70–80 Shore A seems most desirable. Where a conductive framing is needed, the elastomer could comprise silicone rubber filled with graphite, conductive PVC or a conductive polyester such as Hytrel sold by DuPont.

BRIEF DESCRIPTION OF THE DRAWINGS

FIG. 1 is a perspective view, partially broken away, showing the improved elastomeric framing member;

FIG. 2 is a perspective view of a prior art screen deck and framing assembly;

FIG. 3 is a front view of the framing member of FIG. 1; and

FIG. 4 is a perspective view of an assembly of a screen deck panel and the improved framing member, with portions of the rear side framing member omitted for clarity.

DESCRIPTION OF THE PREFERRED EMBODIMENT

FIGS. 1 and 3 show the details of construction of the molded elastomeric framing member 10 and FIG. 4 shows a pair of such members in assembled relationship to a screen deck panel 36. The framing member 10 is preferably molded of an elastomer which can absorb vibration while providing resistance to abrasion and wear from both the material being vibrated on the screen deck and from the screen deck per se. A polyurethane material having a durometer of Shore 80 A appears to be quite satisfactory. The member 10 has a vertical rear wall 12, an upper wall 14, a lower wall 16, and an intermediate wall 18 which is spaced from the upper wall so as to define a horizontal elongated slot 20. A plurality of vertical walls 24, 26 are spaced from each other to define vertical slots 28. Open areas 30 are provided to reduce the amount of elastomer required and to permit all of the molded walls to have a relatively uniform thickness, thus making the member easier to mold.

The framing member 10 is adapted to be manually mounted on each side of a screen deck panel 36. As shown in FIG. 4, the panel 36 is formed of a series of profiled surface wires 38 which are welded to rectangular bars 40. The horizontal slot 20 (FIG. 1) is deep enough to accommodate several of the wires 38, while the vertical slots 28 accommodate the bars 40 and prevent their normally rough ends 40' from injuring anyone handling the panel. The upper surface of wall 18 supports the load of the panel and of the material dumped upon it during use. The upper wall 14 and the lower wall 16 are adapted to be engaged by mounting and clamping means (not shown) which are carried by the vibrating screen apparatus (not shown) on which the panel 36 is adapted to be mounted. The walls 14 and 16 isolate the metal parts of the panel 36 from the metal parts of the screen apparatus, thus decreasing the noise of the screening operation and eliminating or reducing wear. Where an electrical ground must exist between the panel and the screening apparatus, the elastomeric material forming the frame member 10 can be filled with conductive material or a ground wire can be connected between the panel and screening apparatus.

The advantages of the improved framing member 10 will be readily evident by comparing the assembly shown in FIG. 4 to the prior art assembly of FIG. 2. In the latter, it is necessary for metal support strips 144 to be welded at 145 to the bars 140 at each side of the panel. Elastomeric strips 146, 148 are then bonded to the bottom of strips 144 and to several of the profiled wires 138. To protect users from the rough cut ends of the bars 140, a vertical metal strip 150 is usually welded as shown at 152. The assembly of FIG. 4 eliminates the metal strips 144 and 150, the numerous welds 145, 152, the elastomeric strips 146, 148, and the bonding operation for attaching the strips. Since the members 10 can be manually mounted on the panels 36, they may be reused, if desired, when the wires 38 become worn through.

I claim as my invention:

1. A molded elastomeric framing member which is adapted to receive a side edge portion of a flat deck metal screen panel which has a generally horizontal top surface formed of a plurality of parallel, longitudinally extending profiled wires welded to a plurality of transversely extending, generally vertically oriented support bars, said framing member comprising an elongated, elastomeric, channel-like molded member having a top wall, a bottom wall and a connecting outer rear wall, said member having a generally rectangular cross-section, parallel, continuous top and bottom surfaces, and a generally planar and continuous outer side surface on said rear wall, the inner side surface of said member being slotted to form an elongated, continuous horizontal slot parallel to the top surface and a plurality of vertical slots which are widely spaced relative to their width, and which extend downwardly from said continuous slot and are in intersecting relation thereto, said vertical slots having their lower ends spaced from the bottom surface of said framing member by the thickness of said bottom wall, said elongated, continuous slot having its top defined by said top wall and being sized so that it is adapted to receive a plurality of the profiled wires at the side edge of a flat deck screen panel, said vertical slots being sized so that they are adapted to receive portions of one end of all of the vertical support bars on a side edge of a flat deck screen panel, each of said plurality of vertical slots being defined on its sides by a pair of vertical wall portions extending from and integral with the bottom wall of the framing member, the outer rear wall of the framing member, and the wall portion of the framing member which defines the bottom of the continuous horizontal slot, said vertical slots being spaced sufficiently far apart that open recesses formed in said inner side surface in the space between the adjacent vertical wall portions of adjacent vertical slots have a horizontal width substantially greater than the width of the vertical wall portions, the top and bottom surfaces of said framing member being adapted to be engaged by clamping and support portions of a vibrating screen apparatus so as to prevent metal-to-metal contact between said screen apparatus and said screen panel.

2. An elastomeric framing member in accordance with claim 1 wherein the elastomeric material contains conductive particles for preventing a metal screen panel from becoming electrically isolated from a vibrating screen to which it is adapted to be mounted.

3. An elastomeric framing member in accordance with claim 1 wherein the elastomeric material has a durometer in the range of about 60–90 Shore A.

4. An elastomeric framing member in accordance with claim 3 wherein the elastomeric material has a durometer in the range of about 70–80 Shore A.

5. An elastomeric framing member in accordance with claim 4 wherein the elastomeric material is polyurethane.

6. An elastomeric framing member in accordance with claim 1 wherein the wall portions of said member which are defined by said surfaces, recesses and slots are all of generally uniform thickness.

* * * * *